US006588582B2

(12) United States Patent
Rebeaud

(10) Patent No.: US 6,588,582 B2
(45) Date of Patent: Jul. 8, 2003

(54) DEVICE FOR BRAKING A MACHINE FOR PROCESSING ELEMENTS IN SHEET FORM

(75) Inventor: Jean-Claude Rebeaud, Le Mont-sur-Lausanne (CH)

(73) Assignee: Bobst, S.A. (CH)

( * ) Notice: Subject to any disclaimer, the term of this patent is extended or adjusted under 35 U.S.C. 154(b) by 0 days.

(21) Appl. No.: 09/853,271

(22) Filed: May 10, 2001

(65) Prior Publication Data

US 2001/0040085 A1 Nov. 15, 2001

(30) Foreign Application Priority Data

May 12, 2000 (CH) ..... 0934/00

(51) Int. Cl.[7] ..... B65G 15/00
(52) U.S. Cl. ..... 198/836.2; 271/182
(58) Field of Search ..... 198/836.2; 271/182

(56) References Cited

U.S. PATENT DOCUMENTS 5,060,928 A * 10/1991 Vits ..... 271/182
5,129,643 A * 7/1992 Johnson et al. ..... 271/216
5,265,862 A * 11/1993 Jones et al. ..... 271/202
5,366,217 A * 11/1994 Tokuno et al. ..... 271/176
5,415,389 A * 5/1995 Adami ..... 271/203
5,560,595 A * 10/1996 Kulpa ..... 271/2
5,599,012 A * 2/1997 Rebeaud ..... 271/182
5,671,920 A * 9/1997 Acquaviva et al. ..... 271/307
5,697,610 A * 12/1997 Holmes et al. ..... 271/263
5,992,844 A * 11/1999 Dillinger et al. ..... 271/182
6,145,833 A * 11/2000 Rodewald et al. ..... 271/182
6,231,041 B1 * 5/2001 Jacques ..... 271/121
6,296,029 B1 * 10/2001 Grivna ..... 144/373
6,398,211 B1 * 6/2002 Schalk ..... 271/182

FOREIGN PATENT DOCUMENTS

CH 689977 2/2000 ..... 29/68

* cited by examiner

*Primary Examiner*—Christopher P. Ellis
*Assistant Examiner*—Rashmi Sharma
(74) *Attorney, Agent, or Firm*—Ostrolenk, Faber, Gerb & Soffen, LLP

(57) ABSTRACT

The braking device comprises at least one flexible braking means (1) extending across the trajectory of the sheets (2) and mounted so as to pivot around a transverse axis (4) so that its trajectory around the axis intersects the trajectory of the sheets (2), the direction of rotation of the end of the flexible braking means (1) and intersecting the trajectory of the sheets (2) being opposite the direction of motion of the sheets, and also comprises drive means for pivoting the braking means (1) in dependence on the longitudinal dimensions of the sheets (2) and the frequency with which they pass. The means driving the braking means (1) around the transverse axis (4) comprise a variable-speed electromagnetic actuator (5) connected to control means which in real time record the parameters relating to the longitudinal dimension of the sheets and the frequency with which they pass.

8 Claims, 4 Drawing Sheets

*All positions possible*

*All positions possible*

*Rise as far as detector*

*Waiting in high position*

*Descent*

*Waiting in low position*

*Rise*

DEVICE FOR BRAKING A MACHINE FOR PROCESSING ELEMENTS IN SHEET FORM

The invention relates to a braking device in a reception station of a machine for processing articles in sheet form.

A machine of this kind usually comprises an insertion station containing a stack of sheets which are successively taken from the top of the stack and conveyed to a feed board. On the feed board, each sheet is positioned against front and side stops before its front edge is gripped by a set of conveying grippers distributed along a transverse bar, the ends of the grippers being secured to lateral drive chains. The conveying grippers entrain the sheets through the various work stations of the machine. The work stations may more particularly be a cutting station followed by a blank ejection station ending at a reception station in which each sheet is released by the conveying grippers and aligned on top of a stack formed on a discharge pallet.

To ensure that the sheet falls uniformly and with the correct alignment, the sheet must be substantially flat when it stops, at the moment when the conveying grippers open. To this end the sheet arriving at the station is first held by a rear bearing surface and, if required, by two lateral bearing surfaces, which are subsequently retracted and drop the sheets.

The sheets are fragile and, after the operation of cutting and ejecting the blanks, form only fragile grids of blanks. Also the grids arrive at the reception station at high speed and if slowed down simply by deceleration of the front gripper bar, the rear part of the sheet may cockle and tend to overtake the front part. The waste grid must therefore be slowed down by a complementary device acting against its surface.

CH patent 689 977 has already proposed a device of this kind, comprising a flexible braking means in the form of a long brush extending across the trajectory of the sheets and mounted so as to be pivotable around a transverse axis, so that its trajectory around the axis intersects the trajectory of the sheets, the direction of rotation of the end of the flexible braking means intersecting the trajectory of the sheets being opposite to the direction of motion thereof. The device comprises drive means for pivoting the braking means in dependence on the longitudinal dimension of the sheets and the frequency with which they pass.

In this device, the motion of the braking means is controlled by a cam connected by a kinematic chain to the mechanism driving the machine. The cam acts on the braking means via a vertically movable horizontal slide, the downstream part of which has an upwardly sloping surface. Since the braking means is mounted on a longitudinally movable frame, its motion remains constant in the case of sheets having a long longitudinal dimension, then decreases progressively in proportion as the frame is moved forward relative to the sloping part of the horizontal slide.

In a device of this kind, the motion of the braking brush is optimum for a given size of sheet, at the expense of the other sizes. The possibility of descent of the braking brush depends on when the sheet-conveying gripper bar passes. The kinematic connection between the brush-lowering means and the mechanism driving the machine limits the acceleration communicated to the braking brush.

The object of the invention is to eliminate the said disadvantages, at least partly.

To this end the invention relates to a programmable braking device in a reception station of a machine for processing articles in sheet form, as described herein.

By means of the device, the motion of the braking means is always optimum in dependence on the size or format and can be optimised in real time in dependence on the speed of motion of the sheets.

Improvement of the braking of the grids for waste is a key factor in avoiding difficulties through jamming. In order to remove the waste grid at high speed without jamming, the grid must be discharged quickly, the next grid must move above the grid being discharged, the braking brush must grip the grid in order to slow it and the grid must be released from the conveying grippers as soon as possible so as to relax the pressure on the braking brush so that the rear of the grid falls on to the conveyor belt.

By means of the device according to the invention, these conditions can be met for each different size of sheet and at all speeds of the machine, since the control means can drive the electric motor at variable speed with a speed curve adapted to each particular case.

The accompanying drawings are very diagrammatic illustrations, by way of example, of an embodiment of the braking device according to the invention.

FIGS. 4-01 to 4-10 are explanatory diagrams illustrating the various positions of the braking means corresponding to the successive states in the block diagram in FIG. 3, and FIG. 5 is a block diagram of the control loop used in states 6–10 in the diagram in FIG. 3.

Figure 1:
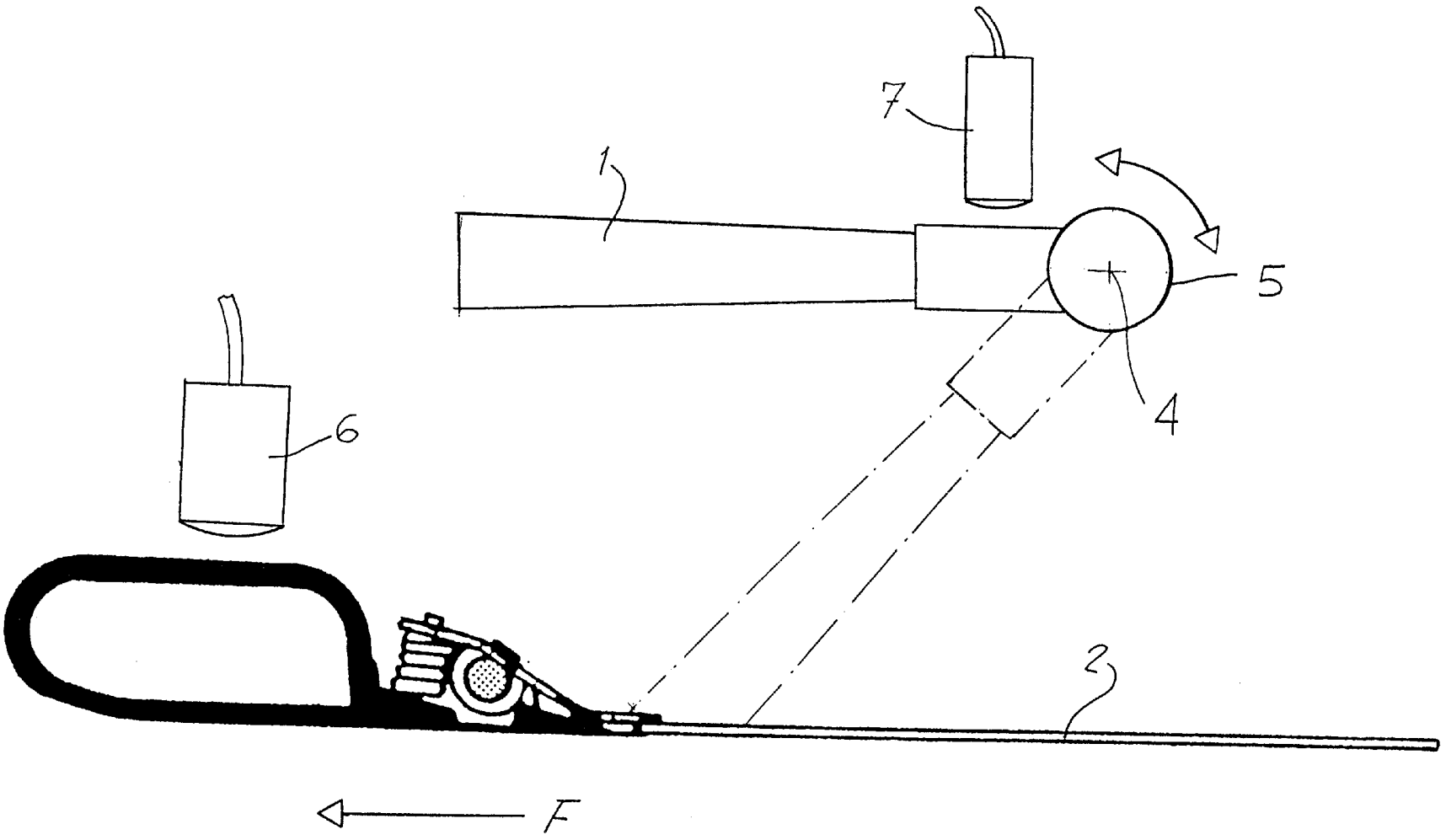
FIG. 1 is a side view of a block diagram of the braking device.

For easier understanding of the following description, the terms "upstream" and "downstream" are used with respect to the direction of travel of the sheets. An upstream part extends towards the station inlet at the right of FIG. 1 whereas the downstream part extends towards the left of the drawing. For simplicity, the drawing shows only the movement of the flexible braking means, in the present case in the form of a brush 1 extending across the direction of motion F of the sheets 2, since only the braking device is the subject of the invention and machines of this kind, such as cutting machines or cutting and sheet-printing machines, are well-known in the sheet-processing sector.

Accordingly the sheets 2 are moved from right to left in FIG. 1 by a transverse bar 3 bearing a number of grippers which hold the front edges of the sheets 2 and pull them in the direction of arrow F. In the example, the brush 1 is mounted so as to pivot around a transverse axis 4 around which it can move between two limit positions illustrated in FIG. 1 by a continuous line (the top position) or a chain-dotted line (the bottom position). An electromechanical actuator, a geared motor unit 5 in this example, drives the brush 1 in one or the other directions around the transverse pivoting axis 4.

Although the example described relates to a braking means comprising a pivoting brush, it will be obvious to the skilled man that the means can be any suitable braking means which can move in a noncircular manner, e.g. parallel or substantially parallel to the trajectory of the sheets 2 for braking or to the bearing surface on which the sheets 2 move.

A detector 6 detects when the gripper bar 3 passes, and a detector 7 detects when the braking brush 1 is in the raised position. The brush 1 must be in the raised position in order to enable the transverse gripper bar 3 to pass, but must be lowered in order to press each sheet 2 against a bearing surface as soon as the gripper bar 3 has passed and the grippers have released the sheet 2.

Figure 3:
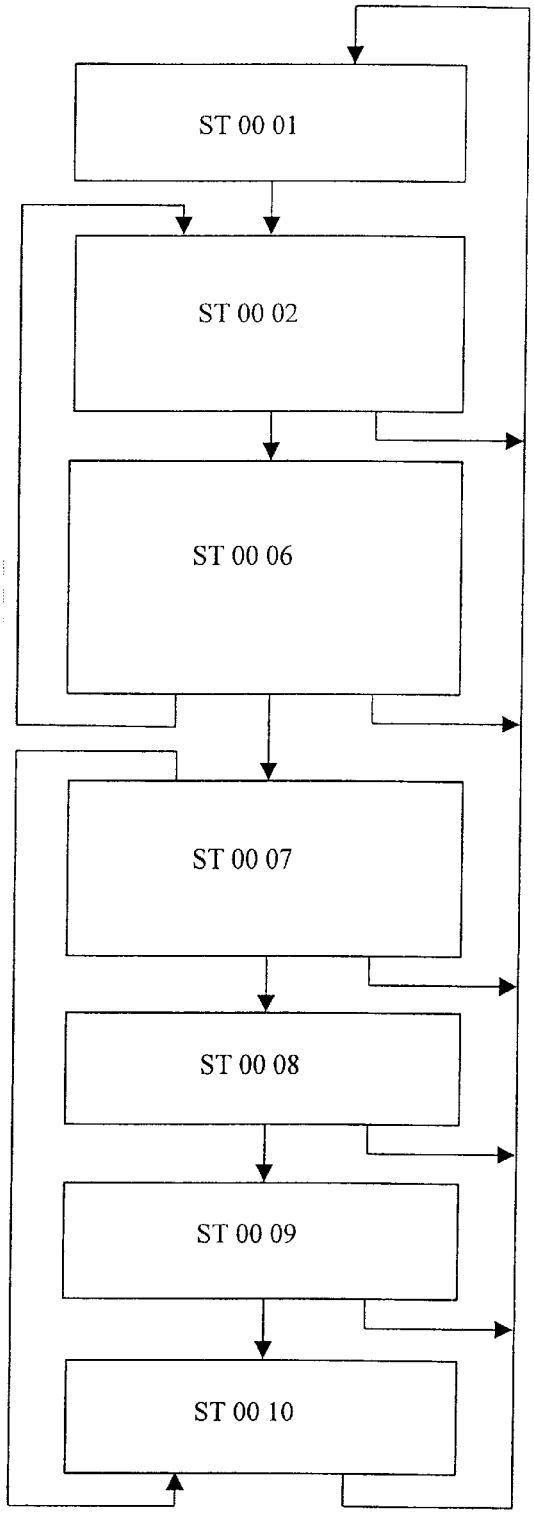
FIG. 3 is a block diagram of the control software of the braking device.

The block diagram of the control software in FIG. 3 is a simplified representation showing only the states relating to the control of the actual brush, which explains the absence of states 03, 04 and 05. State 06 is simplified and in reality contains the entire initialisation procedure, which has not been reproduced here since it is not necessary for understanding the present invention.

Each state in the block diagram in FIG. 3, i.e. 01, 02, 06, 07, 08, 09 and 10, is illustrated by a specific diagram in FIGS. 4-01 to 4-10, the number following the drawing number corresponding to the respective state on the block diagram in FIG. 3. To enable these controls, an absolute coder (not shown) is associated with the geared motor 5 for driving the slowing-down brush 1 and the absolute coder of the machine for processing sheets 2 determines the position of the transverse gripper bar 3.

The first two states ST 00 01 and ST 00 02 in the diagram correspond to the machine starting sequence, which consists in recording the position of the braking brush 1 when the converter of the motor 5 is engaged and then disengaged. The state ST 00-06 corresponds to the movement of the braking brush 1 in the maximum raised position. The deviation between the positions reached by the brush 1 and the zero position provided by the absolute coder of the motor 5 is then measured. If the deviation exceeds a predetermined tolerance, the coder is re-initialised in this position. The position of the brush is then recorded.

In the state ST 00 07, the braking brush is controlled in the high or "parking" position. The positions of the relevant parts of the machine are recorded, together with the position of the gripper bar 3 for determining the instant at which the braking brush 1 must begin to descend.

The descending trajectory of the slowing-down brush 1 is determined in dependence on the position and rate of advance of the sheets 2 in the machine at the stage ST_00_ 08.

The state ST 00 09 is for holding the braking brush 1 in the low position in dependence on the position of the next gripper bar 3 and its speed, or the speed of the machine.

The same parameters are used in the state ST 00 10 to determine the rising trajectory of the braking brush 1 so as to let the next gripper bar pass.

Figure 2:
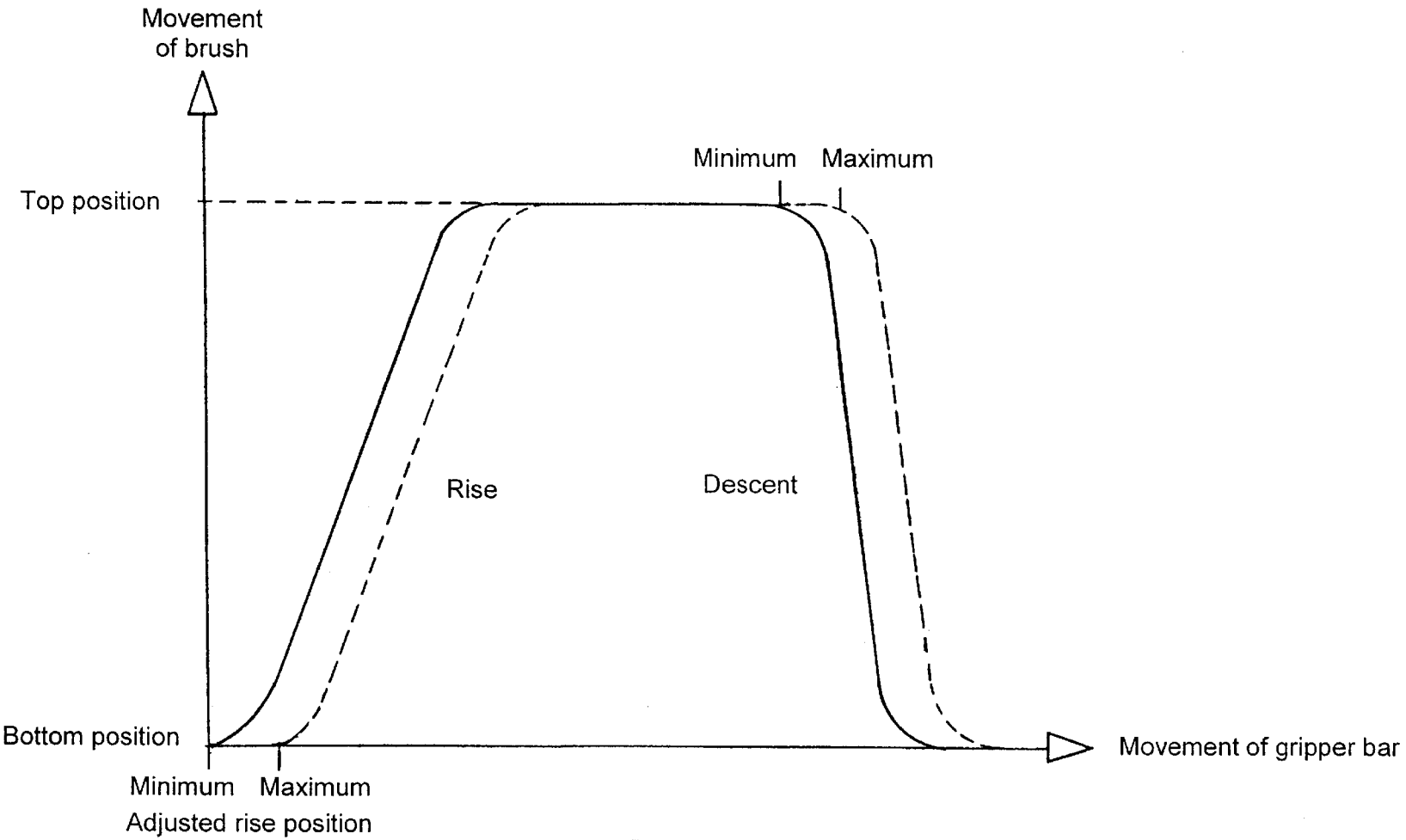
FIG. 2 is a diagram showing the relation between the movements of the braking means and the movement of the sheet.

FIG. 2 illustrates the rising and descending speed curves of the braking brush 1 during a cycle for braking a sheet 2, showing the space between the rise of the braking brush 1 and the descent thereof in order to enable the gripper bar 3 to pass, together with the tolerances for the rise and descent of the brush 1 between the minimum and maximum curves, constituting the window within which the braking brush 1 can move.

Figures 1, 4:
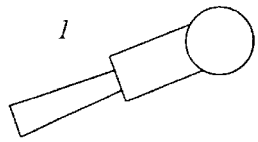
Figures 2, 4:
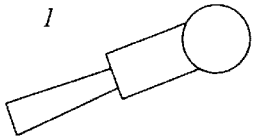
Figures 4, 5, 6:
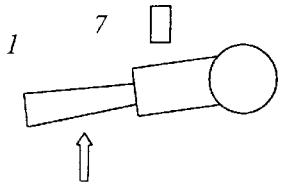
Figures 4, 5, 6, 7:
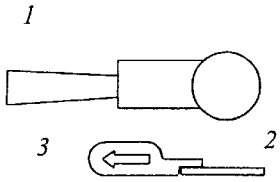
Figures 4, 5, 6, 7, 8:
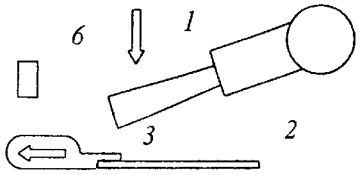
Figures 4, 5, 6, 7, 8, 9:
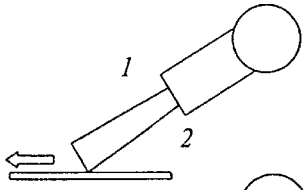
Figures 4, 5, 6, 7, 8, 9, 10:
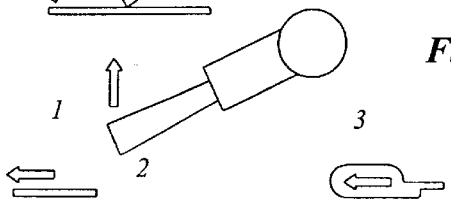
Figure 5:
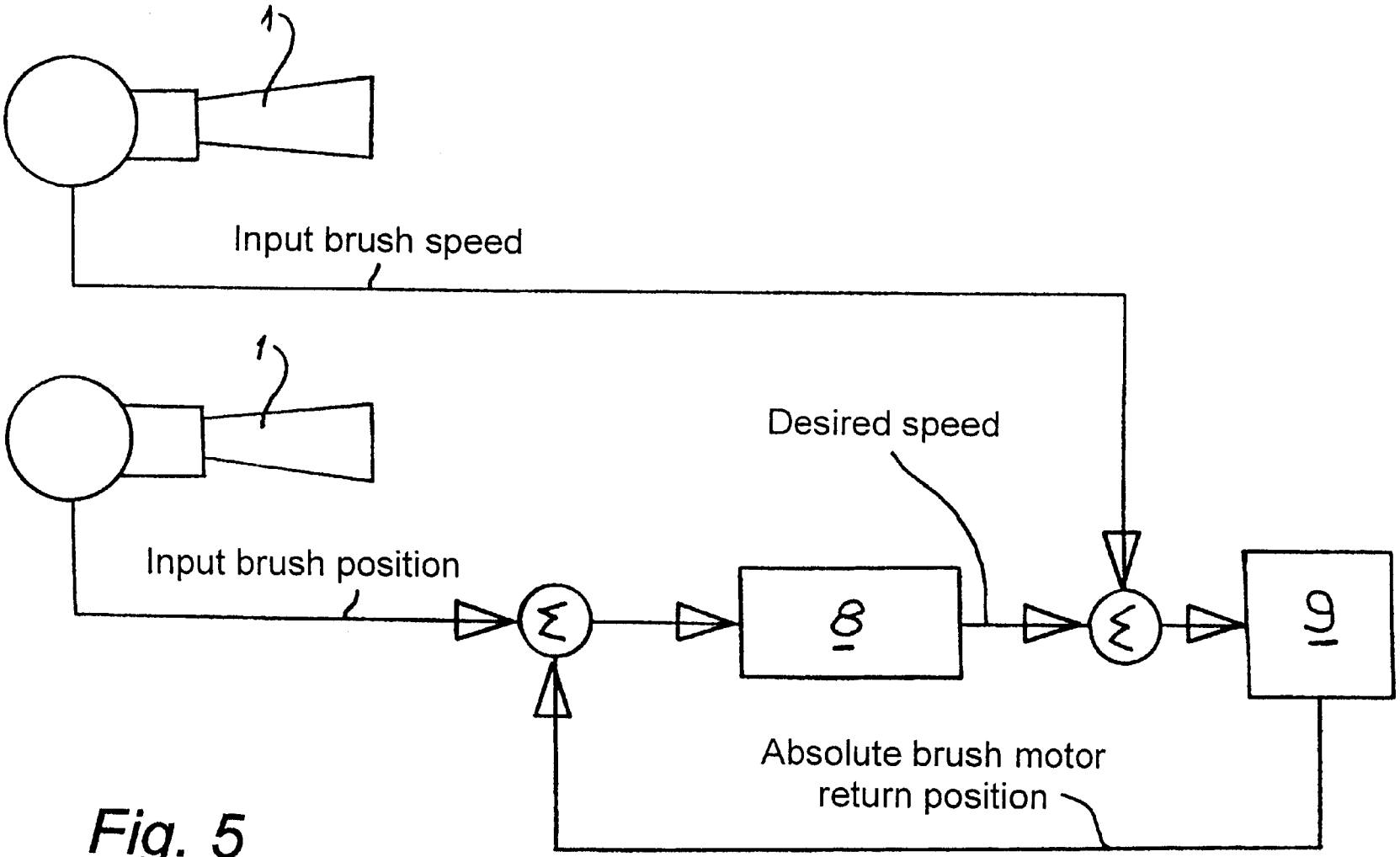

FIG. 5 is a block diagram of a control loop used in states 06, 07, 08, 09 and 10 in the block diagram in FIG. 3. The loop comprises a regulator 8 which in real time receives the position of the braking brush 1 and the absolute position of the geared motor 5 for driving the brush. The regulator delivers a speed signal compared with the speed in real time of the braking brush. The comparison results in a desired control speed of a speed loop 9, which on this basis determines the speed of the geared motor 5 of the braking brush 1 and consequently determines the instantaneous speed of the brush in dependence on the chosen braking parameters.

The operator can adjust the amplitude of motion of the braking brush 1, thus determining the braking force. He can also adjust the degree of the machine at which the brush must descend. This choice is a means of braking the descent of the brush starting from the moment when the detector 6 has detected the passing of the gripper bar 3. It thus determines the degree of the machine at which the braking brush 1 must rise. Finally it determines when the braking brush 1 is put into or out of operation during operation of the machine.

What is claimed is:

1. A braking device for a reception station of a machine for processing articles in sheet form, the device comprising:

at least one braking mechanism extending across the trajectory of the sheets, the braking mechanism being movable between a first limit position at which its trajectory meets that of the sheets, and a second limit position at which it is away from the trajectory of the sheets;

a drive mechanism comprised of a variable speed electro-mechanical actuator, operable to move the braking mechanism between the limit positions; and a controller for the drive mechanism, the controller being operative in real time to record operating parameters including the dimensions of the sheets in the direction of motion thereof to the reception station, and the frequency at which the sheets enter the reception station, the controller also being responsive to the recorded operating parameters to control the operation of the drive mechanism.

2. A device according to claim 1, where in the controller is comprised of a loop including:

a first control circuit which is responsive in real time to a first input signal representing the position of the braking mechanism and a second input signal representing the absolute position of the electro-mechanical actuator to generate an output signal representing the desired operating speed of the electro-mechanical actuator; and a second control circuit which is responsive in real time to the output signal and to a third input signal representing the actual speed of the braking mechanism to control the operating speed of the electro-mechanical actuator.

3. A device according to claim 1, in which the controller is operative to permit modification of the recorded operating parameters.

4. A device according to claim 1, in which one of the recorded operating parameters capable of being modified is the amplitude of motion of the braking mechanism.

5. A device according to claim 1, which one of the recorded operating parameters capable of being modified is the timing at which the braking mechanism is to be actuated and de-actuated.

6. A device according to claim 2, in which the controller is operative to permit modification of the recorded operating parameters.

7. A device according to claim 6, which one of the recorded operating parameters capable of being modified is the amplitude of motion of the braking mechanism.

8. A device according to claim 6, in which one of the recorded operating parameters capable of being modified is the timing at which the braking mechanism is to be actuated and de-actuated.

* * * * *